US009022497B2

(12) United States Patent
Endo et al.

(10) Patent No.: US 9,022,497 B2
(45) Date of Patent: May 5, 2015

(54) PRINTING ELEMENT SUBSTRATE, PRINTHEAD, AND PRINTING APPARATUS

(71) Applicant: Canon Kabushiki Kaisha, Tokyo (JP)

(72) Inventors: Wataru Endo, Kawasaki (JP); Makoto Takagi, Yokohama (JP); Masanobu Ohmura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/319,073

(22) Filed: Jun. 30, 2014

(65) Prior Publication Data

US 2015/0029246 A1 Jan. 29, 2015

(30) Foreign Application Priority Data

Jul. 29, 2013 (JP) ..... 2013-157117

(51) Int. Cl.
*B41J 29/38* (2006.01)
*B41J 2/015* (2006.01)
*B41J 2/045* (2006.01)

(52) U.S. Cl.
CPC ..... *B41J 2/0455* (2013.01)

(58) Field of Classification Search
USPC ..... 347/9, 20
See application file for complete search history.

(56) References Cited

U.S. PATENT DOCUMENTS 5,898,206 A * 4/1999 Yamamoto ..... 257/360
2011/0234741 A1* 9/2011 Nagumo ..... 347/224
2014/0078223 A1 3/2014 Ohmura ..... 347/56

FOREIGN PATENT DOCUMENTS

JP 2002-355970 A 12/2002
JP 2010-155452 A 7/2010

* cited by examiner

*Primary Examiner* — Jason Uhlenhake
(74) *Attorney, Agent, or Firm* — Fitzpatrick, Cella, Harper & Scinto

(57) ABSTRACT

A printing element substrate, comprising a printing element, a MOS transistor having a drain terminal, a source terminal and a back gate terminal, the drain terminal being connected to a first power supply node for receiving a first voltage, and a source terminal and a back gate terminal being connected to the printing element, and a unit including a second power supply node different from the first power supply node, and configured to supply a second voltage to a gate terminal of the MOS transistor, wherein, when the first voltage is not supplied to the first power supply node, the unit controls a potential of at least one of the gate terminal and the drain terminal so that a potential difference between the gate terminal and the drain terminal becomes lower than the second voltage.

17 Claims, 11 Drawing Sheets

PRINTING ELEMENT SUBSTRATE, PRINTHEAD, AND PRINTING APPARATUS

BACKGROUND OF THE INVENTION

1. Field of the Invention

The present invention relates to a printing element substrate, a printhead, and a printing apparatus.

2. Description of the Related Art

Inkjet printing apparatuses described in Japanese Patent Laid-Open Nos. 2002-355970 and 2010-155452 each include a printhead for executing printing on a printing medium. The printhead includes a printing element substrate. The printing element substrate includes a printing element and a drive circuit including a drive transistor for driving the printing element. A power supply line for supplying power to the printing element is isolated from the power supply line of the drive circuit. The drive transistor is arranged between the printing element and the power supply line for supplying power to the printing element.

The printing element substrate described in Japanese Patent Laid-Open No. 2002-355970 controls a voltage to be applied to the printing element by the voltage of the control terminal of the drive transistor. Even if potential fluctuations occur in the power supply line for supplying power to the printing element, this arrangement reduces the influence of the potential fluctuations on the voltage to be applied to the printing element.

When, for example, the printhead is not appropriately mounted, no power supply voltage may be supplied to the power supply line for supplying power to the printing element while a power supply voltage is supplied to the power supply line of the drive circuit.

In this case, since the power supply voltage is supplied to the drive circuit, the drive circuit can output a predetermined voltage to the gate of the drive transistor. On the other hand, since no power supply voltage is supplied to the power supply line for supplying power to the printing element, the drain potential of the drive transistor becomes indefinite. When, for example, the drain potential is 0 [V], the channel potential can also become 0 [V]. Therefore, an overvoltage may be generated between the substrate and the gate of the drive transistor, thereby causing an insulation breakdown.

SUMMARY OF THE INVENTION

The present invention provides a technique of reducing the possibility of occurrence of an insulation breakdown in a drive transistor.

One of the aspects of the present invention provides a printing element substrate, comprising a printing element, a MOS transistor having a drain terminal, a source terminal and a back gate terminal. The drain terminal is connected to a first power supply node for receiving a first voltage. The source terminal and the back gate terminal are connected to the printing element. The substrate comprises a unit including a second power supply node different from the first power supply node, and configured to supply a second voltage to a gate terminal of the MOS transistor. When the first voltage is not supplied to the first power supply node, the unit controls a potential of at least one of the gate terminal and the drain terminal so that a potential difference between the gate terminal and the drain terminal becomes lower than the second voltage.

Further features of the present invention will become apparent from the following description of exemplary embodiments with reference to the attached drawings.

DESCRIPTION OF THE EMBODIMENTS (Example of Arrangement of Printing Apparatus)

An example of the arrangement of an inkjet printing apparatus will be described with reference to FIGS. 1A and 1B. The printing apparatus may be a single-function printer having only a printing function, or a multi-function printer having a plurality of functions such as a printing function, FAX function, and scanner function. Furthermore, the printing apparatus can include a manufacturing apparatus for manufacturing a color filter, electronic device, optical device, microstructure, or the like by a predetermined printing method.

Figure 1A:
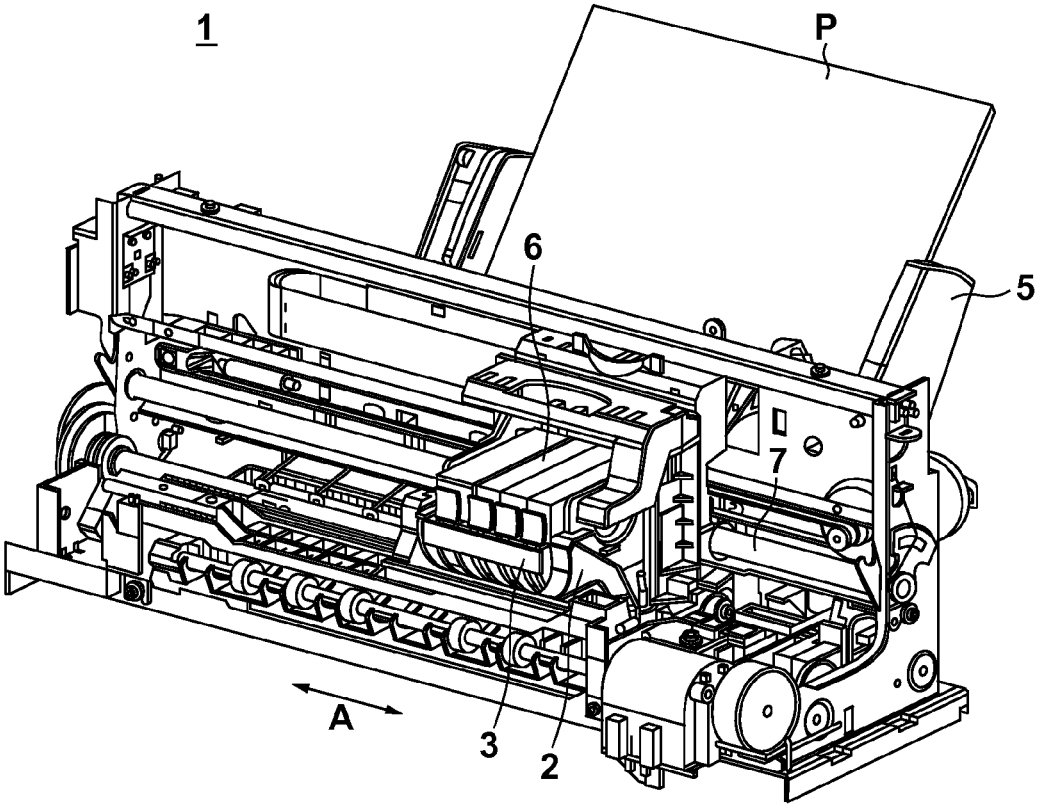
FIGS. 1A and 1B are views for explaining an example of the arrangement of a printing apparatus.

FIG. 1A shows a perspective view showing an example of the outer appearance of a printing apparatus PA. In the printing apparatus PA, a printhead 3 for discharging ink to execute printing is mounted on a carriage 2, and the carriage 2 reciprocates in directions indicated by an arrow A to execute printing. The printing apparatus PA feeds a printing medium P such as printing paper via a sheet supply mechanism 5, and conveys it to a printing position. At the printing position, the printing apparatus PA executes printing by discharging ink from the printhead 3 onto the printing medium P.

In addition to the printhead 3, for example, ink cartridges 6 are mounted on the carriage 2. Each ink cartridge 6 stores ink to be supplied to the printhead 3. The ink cartridge 6 is detachable from the carriage 2. The printing apparatus PA is capable of executing color printing. Therefore, four ink cartridges which contain magenta (M), cyan (C), yellow (Y), and black (K) inks are mounted on the carriage 2. These four ink cartridges are independently detachable.

The printhead 3 includes ink orifices (nozzles) for discharging ink, and also includes a printing element substrate having electrothermal transducers (heaters) corresponding to the nozzles. A pulse voltage corresponding to a print signal is applied to each heater, and heat energy by the heater which has been applied with the pulse voltage generates bubbles in ink, thereby discharging ink from the nozzle corresponding to the heater.

Figure 1B:
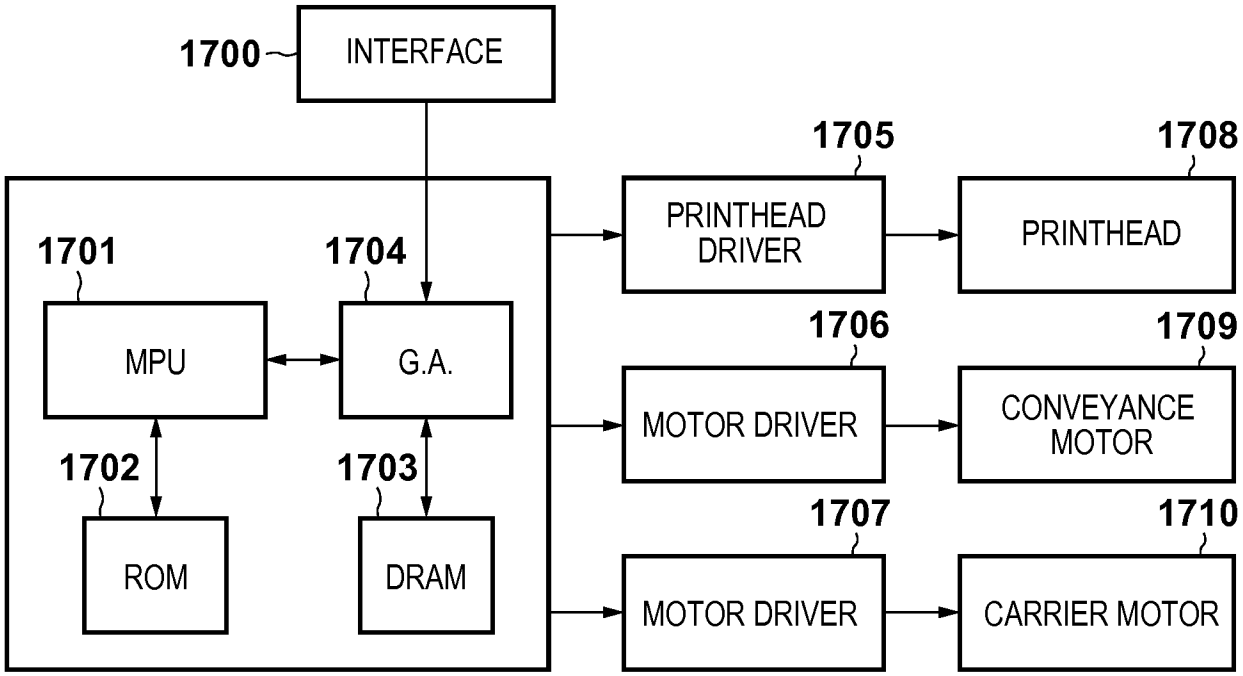

FIG. 1B exemplifies the system arrangement of the printing apparatus PA. The printing apparatus PA includes an interface 1700, an MPU 1701, a ROM 1702, a RAM 1703, and a gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls supply of print data to the printhead 1708, and also controls data transfer between the interface 1700, the MPU 1701, and the RAM 1703.

The printing apparatus PA further includes a printhead driver 1705, motor drivers 1706 and 1707, a conveyance motor 1709, and a carrier motor 1710. The printhead driver 1705 drives the printhead 1708. The motor drivers 1706 and 1707 drive the conveyance motor 1709 and carrier motor 1710, respectively. The conveyance motor 1709 conveys a printing medium. The carrier motor 1710 conveys the printhead 1708.

When a print signal is input to the interface 1700, it can be converted into print data of a predetermined format between the gate array 1704 and the MPU 1701. Each mechanism performs a desired operation in accordance with the print data, thus performing the above-described printing.

(First Embodiment)

Figure 2A:
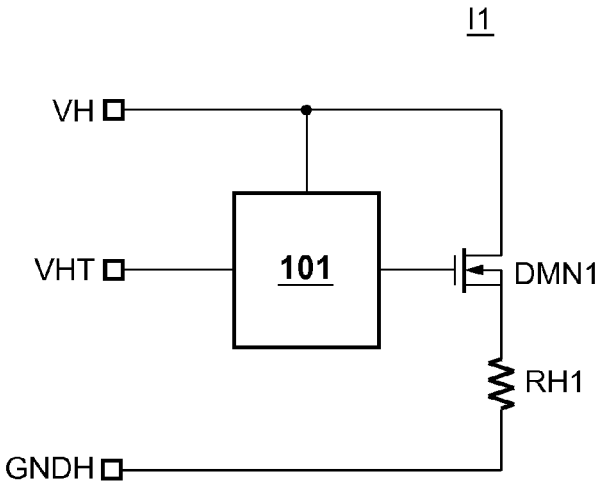
FIGS. 2A and 2B are views for explaining an example of the arrangement of part of a printing element substrate and the arrangement of a high-breakdown voltage transistor.

A printing element substrate I1 according to the first embodiment will be described with reference to FIGS. 2A, 2B, 3, and 4A to 4C. FIG. 2A shows an example of the circuit arrangement of the printing element substrate I1. The printing element substrate I1 includes a heater RH1, an NMOS transistor DMN1, and a unit 101. The heater RH1 is a printing element for executing printing, and is energized to generate heat energy. The transistor DMN1 has a drain terminal which is connected to a power supply node $N_{VH}$ for receiving a first voltage VH (for example, 24 to 32 [V]), and a source terminal and back gate terminal which are connected to the heater RH1. The transistor DMN1 can adopt the structure of a DMOS transistor as a high-breakdown voltage transistor. Note that a voltage is defined as a potential difference with reference to the potential of a ground node in this specification, unless otherwise specified. The ground node is generally a node connected to a terminal on the reference potential side of a power supply.

Figure 2B:
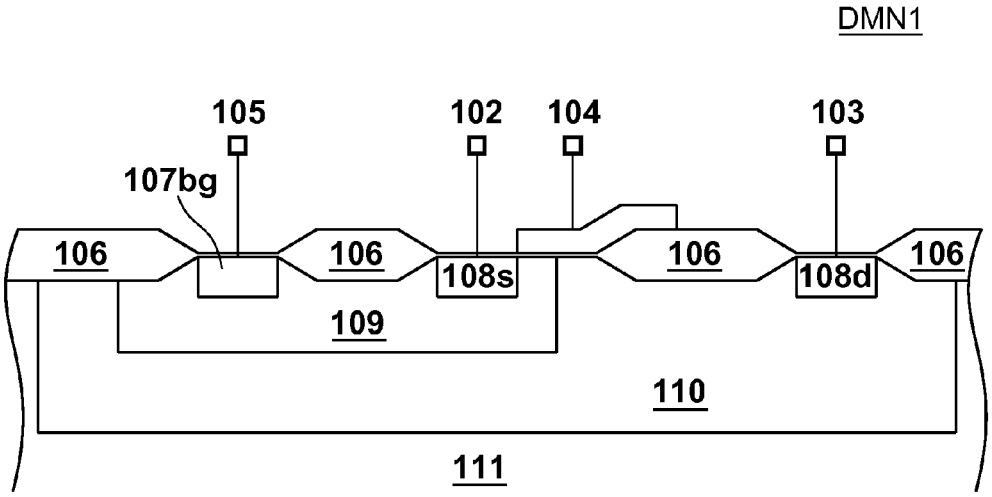

FIG. 2B shows an example of the arrangement of an n-channel DMOS transistor as an example of a transistor used as the transistor DMN1. The structure of the DMOS transistor exemplified here can be formed using a known semiconductor manufacturing process. An n-type semiconductor region 110 is formed in a substrate including a p-type semiconductor region 111, and a p-type semiconductor region 109 is formed in the n-type semiconductor region 110. A heavily doped p-type region 107*bg* is formed in the p-type semiconductor region 109. A heavily doped n-type region 108*s* is also formed in the p-type semiconductor region 109. A heavily doped n-type region 108*d* is formed at a position away from the p-type semiconductor region 109 in the n-type semiconductor region 110. Insulating films including a field oxide film 106 and a gate insulating film are formed on the substrate. Furthermore, a gate electrode is formed on the gate insulating film on a region including the boundary between the p-type semiconductor region 109 and the n-type semiconductor region 110. Part of the gate electrode is formed on the field oxide film 106. A terminal 102 corresponds to a source terminal, a terminal 103 corresponds to a drain terminal, a terminal 104 corresponds to a gate terminal, and a terminal 105 corresponds to a back gate terminal (bulk terminal).

With this arrangement, the transistor DMN1 can function as a high-breakdown voltage transistor. When, for example, the first voltage VH is applied to the drain terminal and a voltage of 0 V is applied to the source terminal, a reverse bias is applied to a p-n junction diode formed by the p-type semiconductor region 109, the heavily doped n-type region 108*d*, and the n-type semiconductor region 110. At this time, the n-type semiconductor region 110 can reduce the electric field from the n-type region 108*d* corresponding to a drain region to the p-type semiconductor region 109 in which a channel is formed. In other words, the potential of the region including the boundary between the p-type semiconductor region 109 and the n-type semiconductor region 110 can be made close to 0 V. Even if, therefore, a voltage close to 0 V is supplied to the gate terminal, no overvoltage is generated between the gate electrode and the cannel. Furthermore, the field oxide film 106 allows insulation between the gate electrode and the n-type region 108*d* corresponding to the drain region to be resistant to a high voltage. This arrangement makes it possible to, for example, electrically isolate the source and back gate from the ground node. When a heater current flows through the heater RH, the source potential rises, thus preventing a gate-source insulation breakdown.

The unit 101 is connected to the gate terminal and drain terminal of the transistor DMN1, and controls the transistor DMN1 in a plurality of operation modes. When the voltage VH is appropriately supplied to the drain terminal of the transistor DMN1, the unit 101 operates in the first mode, and can output, to the gate terminal of the transistor DMN1, a second voltage VHTMH (for example, 24 to 32 [V]) for rendering the transistor DMN1 conductive. The second voltage VHTMH which can render the transistor DMN1 conductive is a voltage corresponding to high level of a signal (to be referred to as an active signal hereinafter) for controlling the transistor DMN1. Alternatively, when the voltage VH is not appropriately supplied to the drain terminal, the unit 101 operates in the second mode, and decreases a potential difference $V_{GD}$ between the gate terminal and the drain terminal. More specifically, in this embodiment, the unit 101 controls the potential of the gate terminal so that the potential difference $V_{GD}$ becomes lower than the second voltage VHTMH.

When the voltage VH is not appropriately supplied, for example, the power supply node $N_{VH}$ is electrically floating or is supplied with a lower voltage than the voltage VH, the potential of the power supply node $N_{VH}$ and the drain potential of the transistor DMN1 become indefinite. For example, when the drain potential is 0 [V], the channel potential is also 0 [V]. On the other hand, regardless of potential of the power supply node $N_{VH}$, even if no voltage VH is supplied, the second voltage VHTMH can be supplied to the gate of the transistor DMN1. As a result, an overvoltage is generated between the gate and the substrate, thereby causing an insulation breakdown. To solve this problem, when no voltage VH is supplied, the unit 101 operates in the above-described second mode, and controls the potential of the gate terminal to decrease the potential difference $V_{GD}$ between the gate terminal and the drain terminal, thereby reducing the possibility of occurrence of an insulation breakdown. Note that it is possible to reduce the possibility of occurrence of an insulation breakdown by making the potential difference $V_{GD}$ between the gate terminal and the drain terminal lower than the second voltage VHTMH even slightly. It is possible to significantly reduce the possibility of occurrence of an insulation breakdown by setting the potential difference $V_{GD}$ between the gate terminal and the drain terminal to 0 V, as a matter of course.

Note that when no voltage VH is supplied, the potentials may generally become equal to the potential of the ground node via the substrate. To avoid the indefinite state of the potentials, however, the power supply node $N_{VH}$ may be pulled down and fixed using, for example, a resistance element having a large resistance value.

Figure 3:
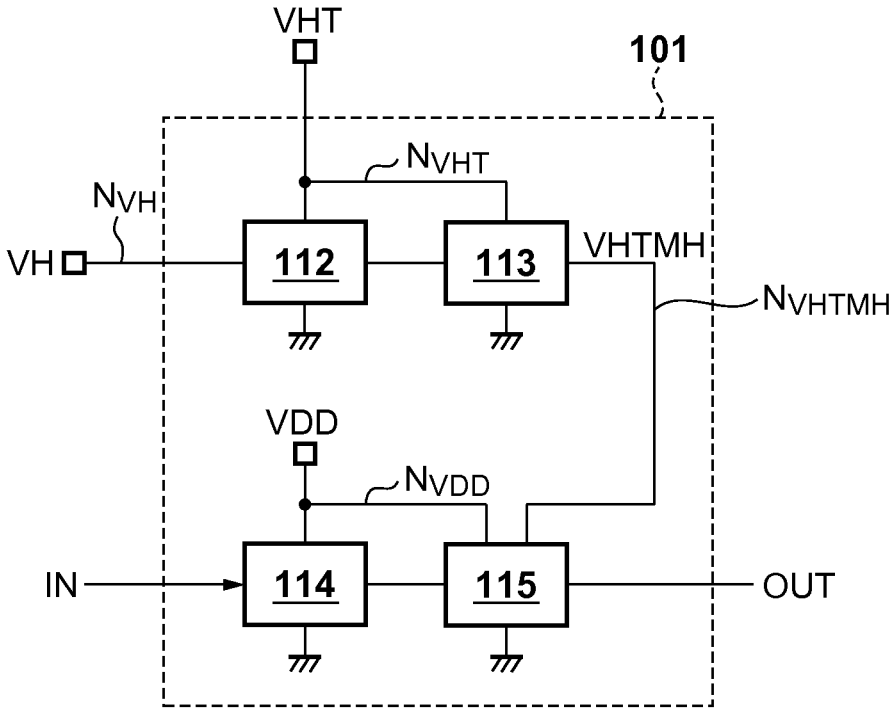
FIG. 3 is a circuit diagram for explaining an example of the arrangement of a unit for controlling a printing transistor.

FIG. 3 shows an example of the circuit arrangement of the unit 101. The unit 101 includes a detection unit 112, a voltage generation unit 113, a signal processing unit 114, and a level shifter 115. The detection unit 112 detects whether the voltage VH is applied, and functions as a monitor unit for monitoring the potential of the power supply node $N_{VH}$. The voltage generation unit 113 receives a third voltage VHT (for example, 24 to 32 [V]), and generates the voltage VHTMH using the voltage VHT based on the output (that is, the monitor result) of the detection unit 112. The signal processing unit 114 processes image signals and control signals from the main body of the printing apparatus. A voltage VDD (for example, 3.3 [V]) as a logic power supply voltage is supplied to the signal processing unit 114. The signal processing unit 114 outputs a signal to each transistor MN via each level shifter 115 based on print data, thereby driving each heater RH. The level shifter 115 is supplied with the voltages VDD and VHTMH, and performs the level shift of the signal from the signal processing unit 114 from the potential level of the voltage VDD to that of the voltage VHTMH to output the resultant signal.

Figure 4A:
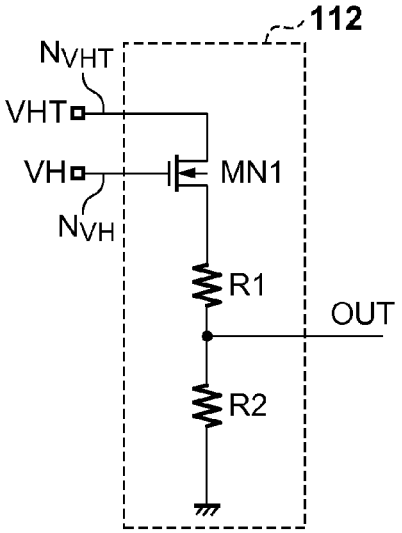
FIGS. 4A to 4C are circuit diagrams for explaining an example of the arrangement of units.

FIG. 4A shows an example of the arrangement of the detection unit 112. The detection unit 112 can be formed using, for example, an NMOS transistor MN1 and resistance elements R1 and R2. The transistor MN1 and the resistance elements R1 and R2 are arranged to form a current path between a power supply node $N_{VHT}$ and the ground node. The gate of the transistor MN1 is connected to the power supply node $N_{VH}$. With this arrangement, the detection unit 112 outputs the potential of the node between the resistance elements R1 and R2 in accordance with the potential of the power supply node $N_{VH}$.

Figure 4B:
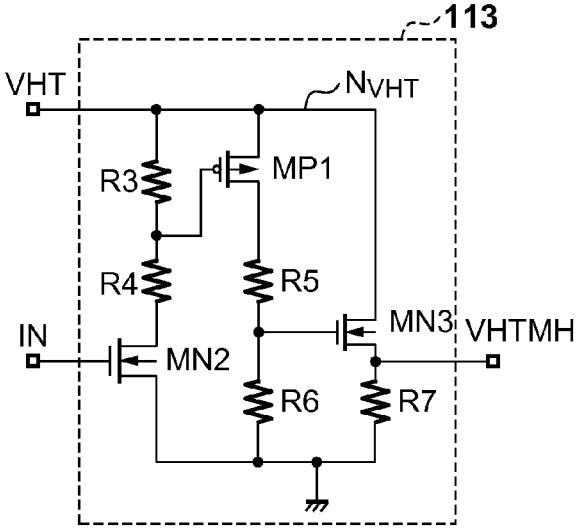

FIG. 4B shows an example of the arrangement of the voltage generation unit 113. The OUT node of the detection unit 112 is connected to the IN node of the voltage generation unit 113. The voltage generation unit 113 can be formed using resistance elements R3 to R7, an NMOS transistor MN2, and a PMOS transistor MP1. The resistance elements R3 and R4 and the transistor MN2 are arranged to form a current path between the power supply node $N_{VHT}$ and the ground node. The transistor MP1 and the resistance elements R5 and R6 are arranged to form a current path between the power supply node $N_{VHT}$ and the ground node. A transistor MN3 and the resistance element R7 are arranged to form a current path between the power supply node $N_{VHT}$ and the ground node. Furthermore, the node between the resistance elements R3 and R4 is connected to the gate of the transistor MP1. The node between the resistance elements R5 and R6 is connected to the gate of the transistor MN3. With this arrangement, the voltage generation unit 113 outputs the potential of the node between the transistor MN3 and the resistance element R7 in accordance with the potential of the gate of the transistor MN2 (that is, the output of the detection unit 112).

In the above arrangement, when the voltage VH is supplied, the voltage generation unit 113 receives the output of the detection unit 112, and outputs the voltage VHTMH. On the other hand, when no voltage VH is supplied, the transistor MN1 is rendered non-conductive, and the output of the detection unit 112 becomes 0 [V], thereby setting the output of the voltage generation unit 113 to 0 [V]. Note that as a result, no voltage VHTMH is supplied to the level shifter 115, and thus the level shifter 115 enters a sleep state.

Figure 4C:
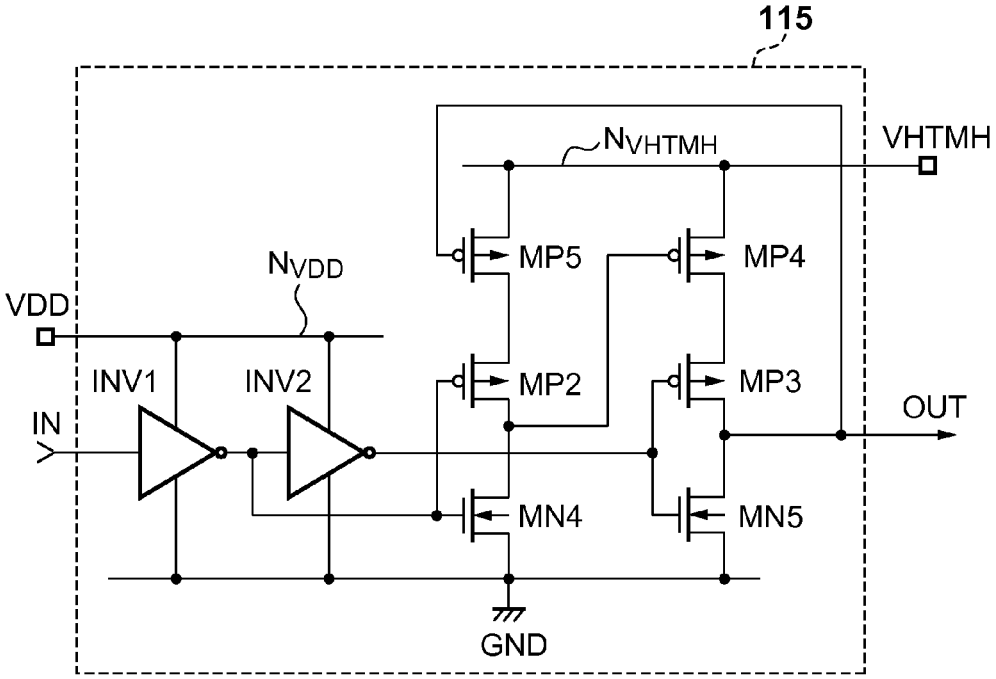

FIG. 4C shows an example of the arrangement of the level shifter 115. The level shifter 115 can be formed using inverters INV1 and INV2, NMOS transistors MN4 and MN5, and PMOS transistors MP2 to MP5. The inverter INV1 receives the output of the signal processing unit 114, and outputs it to the inverter INV2. The NMOS transistors MN4 and MN5 and the PMOS transistors MP2 to MP5 form a circuit unit for receiving the outputs of the inverters INV1 and INV2, and performing the level shift of the potential level of the signal from the signal processing unit 114. More specifically, the transistors MP5, MP2, and MN4 are arranged to form a current path between a power supply node $N_{VHTMH}$ of the voltage VHTMH and the ground node. The transistors MP4, MP3, and MN5 are arranged to form a current path between the power supply node $N_{VHTMH}$ of the voltage VHTMH and the ground node. The gates of the transistors MP2 and MN4 receive the output of the inverter INV1. The gates of the transistors MP3 and MN5 receive the output of the inverter INV2. Furthermore, the node between the transistors MP2 and MN4 is connected to the gate of the transistor MP4. The node between the transistors MP3 and MN5 is connected to the gate of the transistor MP5.

When the voltage VH is supplied, the voltage generation unit 113 supplies the voltage VHTMH to the level shifter 115, and thus the level shifter 115 enters an operation state, and performs the level shift of an active signal from the signal processing unit 114 from the potential level of the voltage VDD to that of the voltage VHTMH to output the resultant signal. That is, when the voltage VH is supplied, the unit 101 including the level shifter 115 operates in the above-described first mode, and can output an active signal for rendering the transistor DMN1 conductive to the gate terminal. The level shifter 115 can also output an inactive signal (low level of a signal for controlling the transistor DMN1) based on the signal from the signal processing unit 114. That is, when the voltage VH is supplied, the unit 101 can have the third mode in which an inactive signal for rendering the transistor DMN1 non-conductive is output to the gate terminal, in addition to the first mode.

On the other hand, when no voltage VH is supplied, the voltage generation unit 113 supplies no voltage VHTMH to the level shifter 115. Therefore, the level shifter 115 is in a sleep state, and performs no level shift to output 0 [V]. As a result, the gate potential of the transistor DMN1 becomes 0 [V]. That is, the unit 101 including the level shifter 115 operates in the second mode in which the gate-drain potential difference $V_{GD}$ of the transistor DMN1 is made lower than the potential difference between the ground level and the potential level of the voltage VHTMH.

This embodiment is advantageous in preventing an insulation breakdown of the transistor DMN1 when no voltage VH is supplied to the heater RH1 and transistor DMN1. More specifically, when no voltage VH is supplied, the unit 101 makes the gate-drain potential difference $V_{GD}$ of the transistor DMN1 lower than the voltage VHTMH. In this embodiment, the unit 101 decreases the potential difference $V_{GD}$ by making the gate potential of the transistor DMN1 close to the drain potential, thereby preventing an insulation breakdown caused by an overvoltage generated between the gate and the substrate.

In this embodiment, the detection unit 112 functions as a controlling unit for controlling the voltage of the gate terminal of the transistor DMN1. Note that the detection unit 112, voltage generation unit 113, and level shifter 115 have been exemplified above as components of the unit 101. The present invention, however, is not limited to them, and each component need only adopt an arrangement having the similar function.

(Second Embodiment)

A printing element substrate I2 according to the second embodiment will be described with reference to FIGS. 5 to 7. In the above-described first embodiment, an arrangement in which one heater RH1 and one NMOS transistor DMN1 are arranged has been exemplified for the sake of simplicity. The present invention, however, is not limited to this. For example, a plurality of heaters and a plurality of transistors respectively corresponding to the heaters may be arranged in a printing element substrate. The printing element substrate I2 is different from the printing element substrate I1 of the first embodiment in that two transistors are arranged to correspond to each heater.

Figure 5:
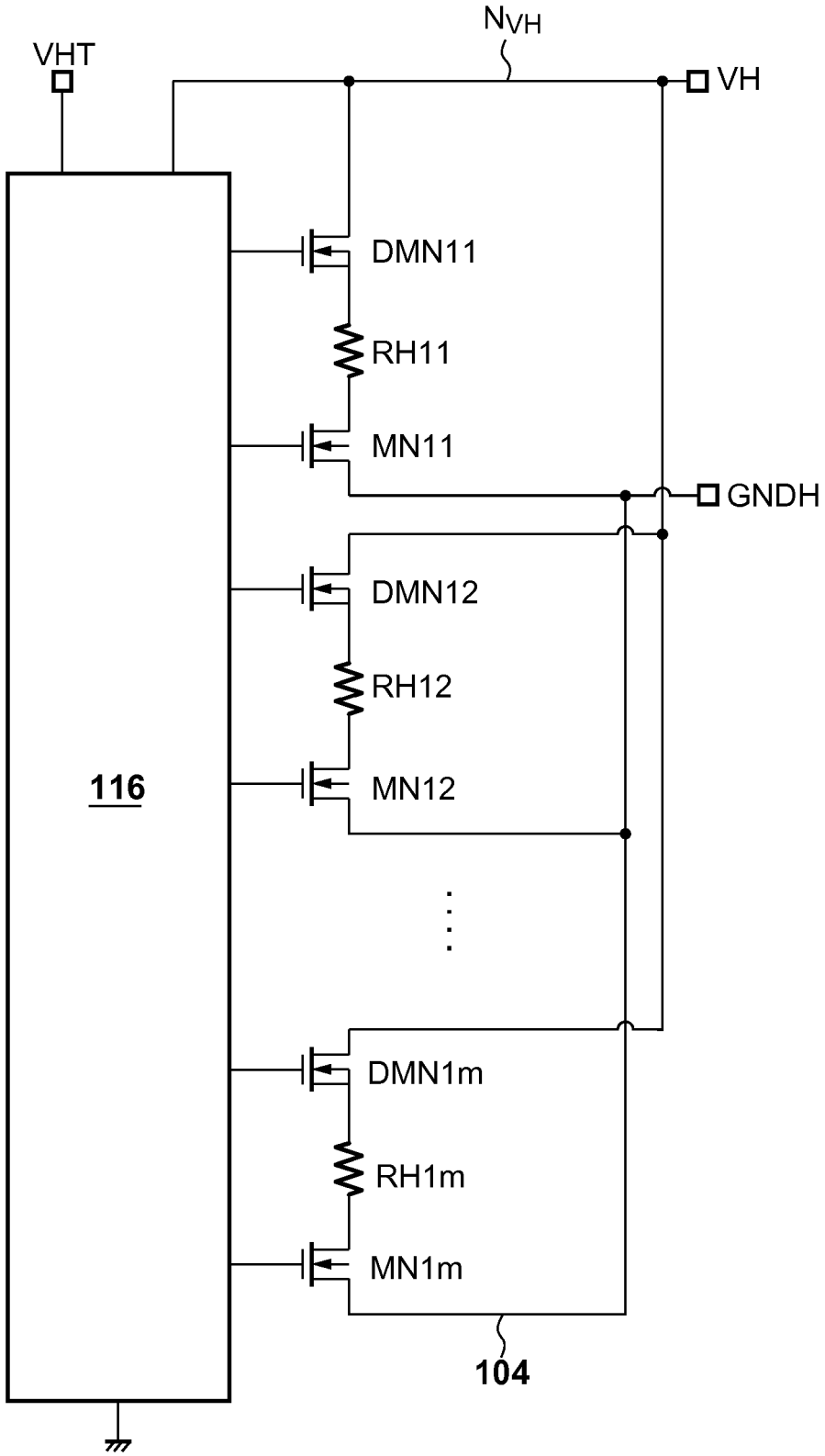
FIG. 5 is a circuit diagram for explaining another example of the arrangement of the printing element substrate.

FIG. 5 shows an example of the arrangement of the printing element substrate I2. The printing element substrate I2 includes a plurality of heaters RH1*k* (RH11 to RH1*m*), a plurality of NMOS transistors DMN1*k* (DMN11 to DMN1*m*), and a plurality of NMOS transistors MN1*k* (MN11 to MN1*m*) (k=1 to m). Each transistor MN1*k* is a transistor for driving the corresponding heater RH1*k*. Each transistor DMN1*k* is a transistor for supplying a constant current to the corresponding heater RH1*k*. Furthermore, the printing element substrate I2 includes a unit 116 for controlling the transistors DMN1*k* and MN1*k*. Voltages VH and VHT are supplied to the unit 116. The unit 116 corresponds to the aforementioned unit 101. Similarly to the first embodiment, when no voltage VH is supplied, the unit 116 controls each transistor DMN1*k* so that a gate-drain potential difference $V_{GD}$ of the transistor becomes low.

Figure 6:
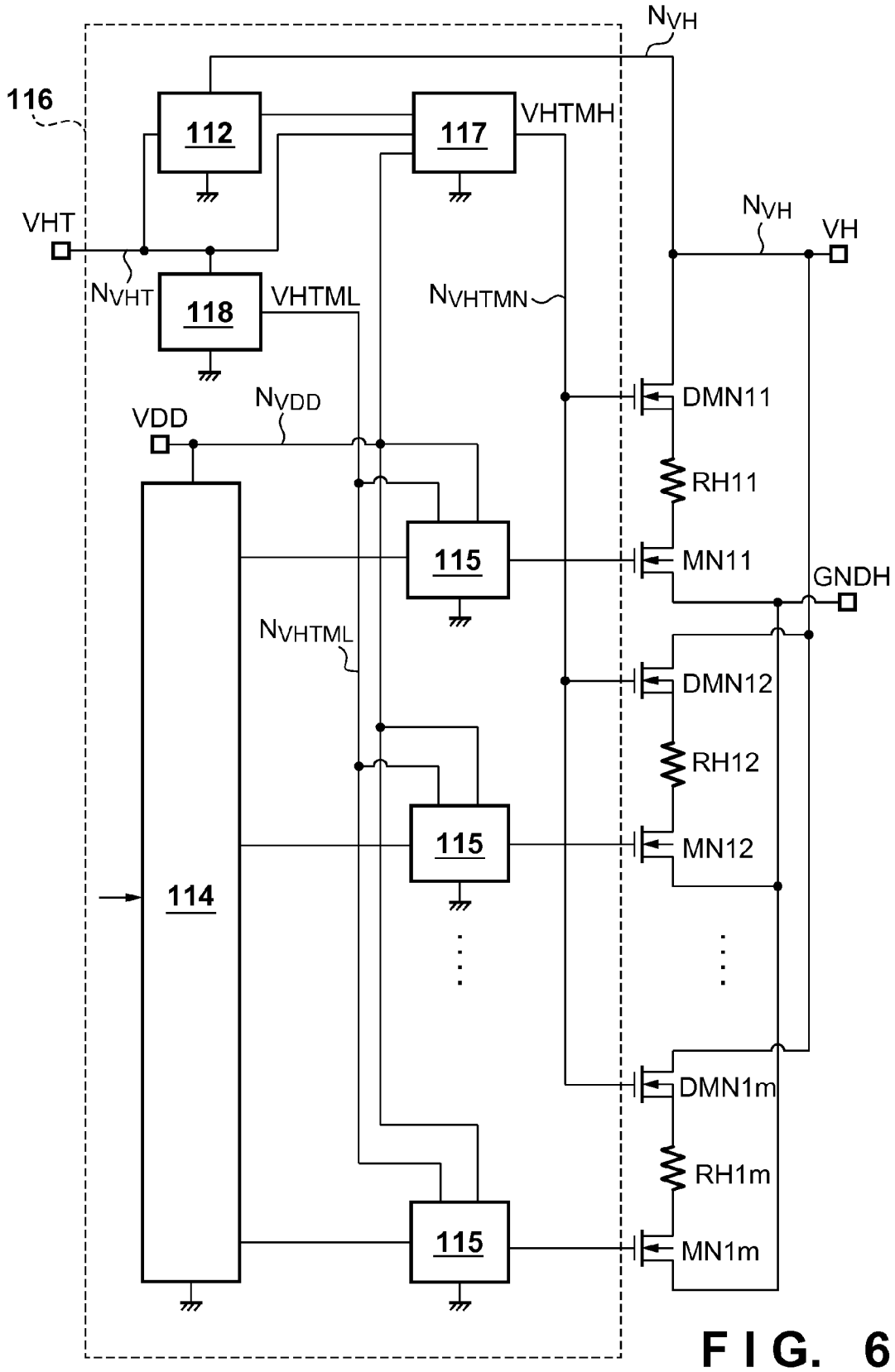
FIG. 6 is a circuit diagram for explaining the other example of the arrangement of the printing element substrate.

FIG. 6 shows an example of the arrangement of the unit 116 in more detail. The unit 116 includes the aforementioned detection unit 112, the aforementioned signal processing unit 114, a plurality of level shifters 115 arranged to correspond to the respective transistors MN1*k*, a first voltage generation unit 117, and a second voltage generation unit 118.

The first voltage generation unit 117 performs the same operation as that of the aforementioned voltage generation unit 113, and generates a voltage VHTMH (for example, 24 to 32 [V]) using the voltage VHT based on the output of the detection unit 112. The generated voltage VHTMH is supplied to the gate of each transistor DMN1*k* via a power supply node $N_{VHTMH}$. This causes each transistor DMN1*k* to perform a source follower operation, and thus the source potential is fixed at the gate potential. Even if, therefore, potential fluctuations occur at a power supply node $N_{VH}$ of the voltage VH, a constant current can be supplied to the heater RH1*k*.

Figure 7:
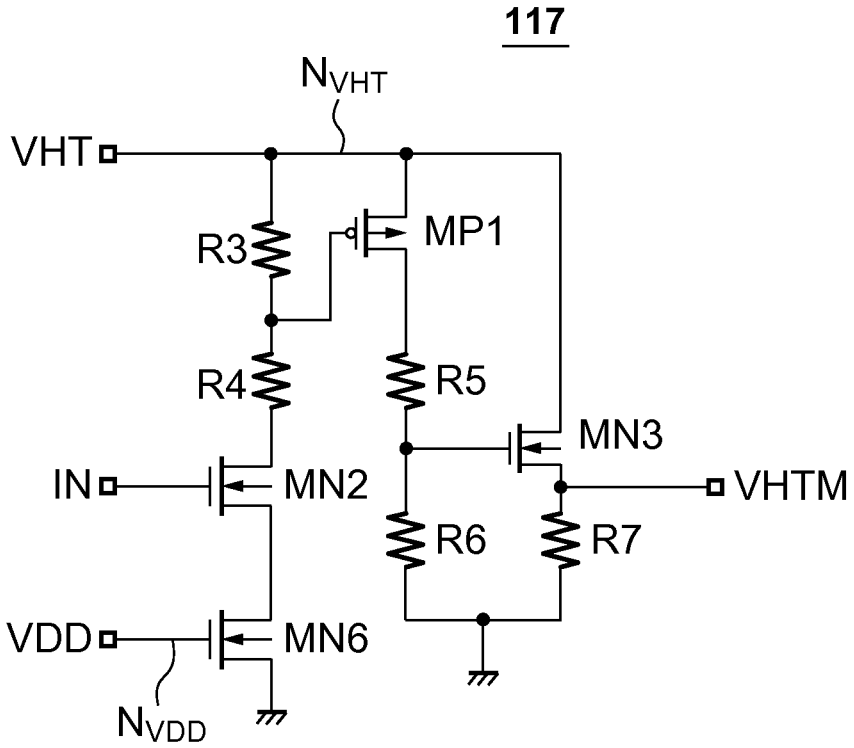
FIG. 7 is a circuit diagram for explaining another example of the arrangement of the unit.

FIG. 7 shows an example of the arrangement of the voltage generation unit 117. The voltage generation unit 117 is formed using an NMOS transistor MN6 in addition to the arrangement of the voltage generation unit 113 shown in FIG. 3B. More specifically, the transistor MN6 is arranged between a transistor MN2 and a ground node, and has a gate connected to a power supply node $N_{VDD}$.

The voltage generation unit 118 is connected to a power supply node $N_{VHT}$ of the voltage VHT, and generates a voltage VHTML (for example, 3 to 5 [V]) using the voltage VHT. The generated voltage VHTML is supplied to each level shifter 115 via a power supply node $N_{VHTML}$. This causes each level shifter 115 to perform the level shift of a signal from the signal processing unit 114. The signal processing unit 114 outputs a signal to each transistor MN1*k* via each level shifter 115 based on print data. In response to this, each heater RH1*k* is driven.

With the above-described arrangement, when the voltages VH and VDD are appropriately supplied, the voltage generation unit 117 receives the output of the detection unit 112 to render the transistor MN2 conductive and also render the transistor MN6 conductive. As a result, transistors MP1 and MN3 are also rendered conductive, thereby generating the voltage VHTMH.

On the other hand, when at least one of the voltages VH and VDD is not appropriately supplied, the transistor MN2 or MN6 is rendered non-conductive. Therefore, the gate potential of the transistor MP1 becomes equal to the voltage VHT, and thus the transistor MP1 is rendered non-conductive. Consequently, the gate potential of the transistor MN3 becomes equal to the potential of the ground node, and thus the transistor MN3 is rendered non-conductive. The voltage generation unit 117 generates no voltage VHTMH, and outputs 0 [V].

According to this embodiment, when the voltages VH and VDD are supplied, the voltage generation unit 117 supplies an active signal of the potential level of the voltage VHTMH to each transistor DMN1*k*. As a result, the transistor DMN1*k* supplies a constant current to the heater RH1*k*.

On the other hand, when at least one of the voltages VH and VDD is not supplied, the voltage generation unit 117 outputs 0 [V]. This results in the gate-drain potential difference $V_{GD}$ of each transistor DMN1*k*, which is lower than the voltage VHTMH. In this embodiment, therefore, it is also possible to obtain the same effects as those in the first embodiment. Furthermore, this arrangement is advantageous in reducing the power consumption since the transistors MP1 and MN3 and at least one of the transistors MN2 and MN6 are non-conductive, and the current path between the power supply node $N_{VHT}$ and the ground node is cut off. In addition, since each transistor DMN1*k* is rendered non-conductive when the voltage generation unit 117 outputs 0 [V], it is possible to prevent an operation error of each heater RH1*k* and damage to the heater caused by the operation error.

In this embodiment, the detection unit 112 functions as a controlling unit for controlling the voltage of the gate terminal of the transistor DMN1. Note that the arrangement of the voltage generation unit 117 of the unit 116 has been exemplified above. The present invention, however, is not limited to this, and it is only necessary to adopt an arrangement having the similar function.

(Third Embodiment)

Figure 8A:
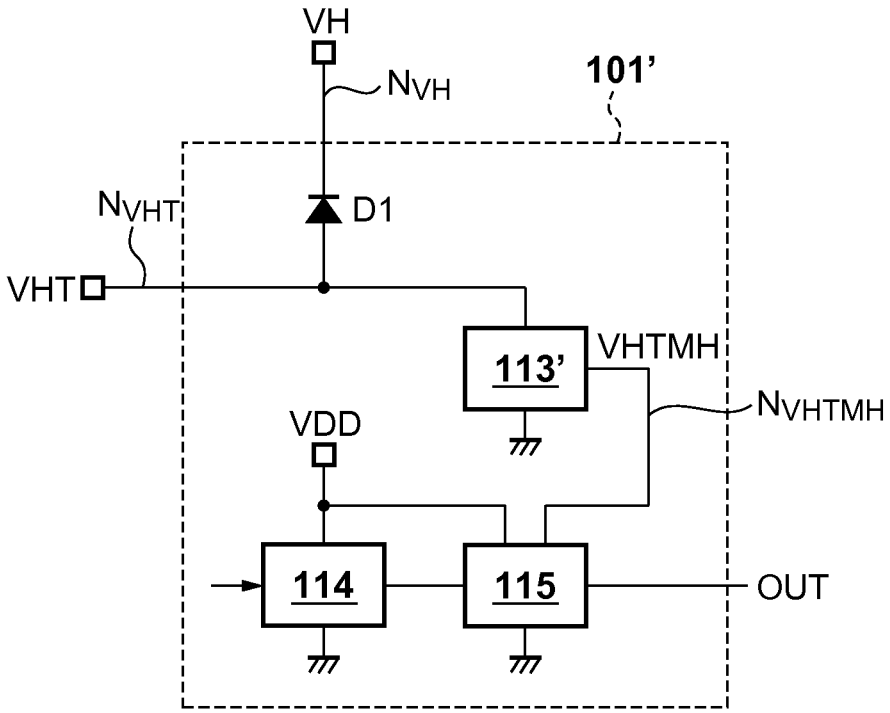
FIGS. 8A and 8B are circuit diagrams for explaining still another example of the arrangement of the units.

The third embodiment will be described with reference to FIGS. 8A and 8B. The third embodiment is different from the first embodiment in that a diode D1 is used in a unit 101' instead of the detection unit 112, as exemplified in FIG. 8A. The diode D1 is arranged between power supply nodes $N_{VHT}$ and $N_{VH}$ so that the anode is set on the $N_{VHT}$ side and the cathode is set on the $N_{VH}$ side. When the potential of the power supply node $N_{VH}$ becomes lower than that of the power supply node $N_{VHT}$ and the potential difference between the nodes becomes, for example, 0.6 [V] or higher, the diode D1 causes a current to flow from the power supply node $N_{VHT}$ to the power supply node $N_{VH}$. That is, when no voltage VH is supplied, the power supply node $N_{VHT}$ supplies a voltage to the power supply node $N_{VH}$ via the diode D1. This raises the potential of the power supply node $N_{VH}$ to make the drain potential of a transistor DMN1 close to the gate potential, thereby decreasing a gate-drain potential difference $V_{GD}$.

Figure 8B:
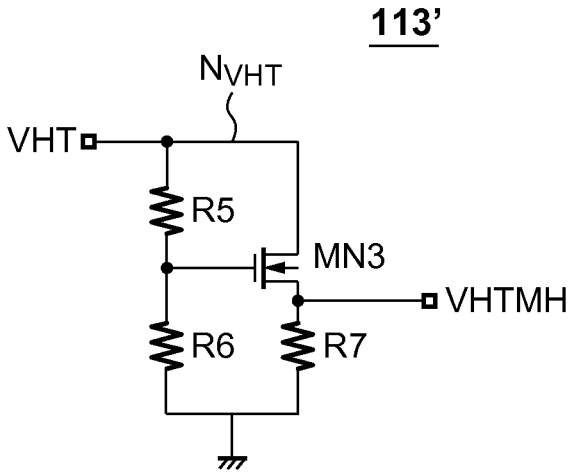

FIG. 8B shows an example of the arrangement of a voltage generation unit 113'. The voltage generation unit 113' can be formed using part of the arrangement of the voltage generation unit 113 shown in FIG. 3B described above. More specifically, resistance elements R5 and R6 are arranged to form a current path between the power supply node $N_{VHT}$ and a ground node, and a transistor MN3 and a resistance element R7 are arranged to form a current path between the power supply node $N_{VHT}$ and the ground node. In this arrangement, a divided voltage of a voltage VHT by the resistance elements R5 and R6 is input to the gate of the transistor MN3, thereby outputting a voltage VHTMH according to the divided voltage.

According to this embodiment, even if no voltage VH is supplied, a current can flow through a heater RH1. However, when a current flows through the heater RH1, the source potential of the transistor DMN1 rises, thus preventing an insulation breakdown caused by an overvoltage generated between the gate and the substrate. That is, in the embodiment in which the drain potential of the transistor DMN1 is made close to the gate potential when no voltage VH is supplied, it is also possible to obtain the same effects as those in the first embodiment.

Figure 9:
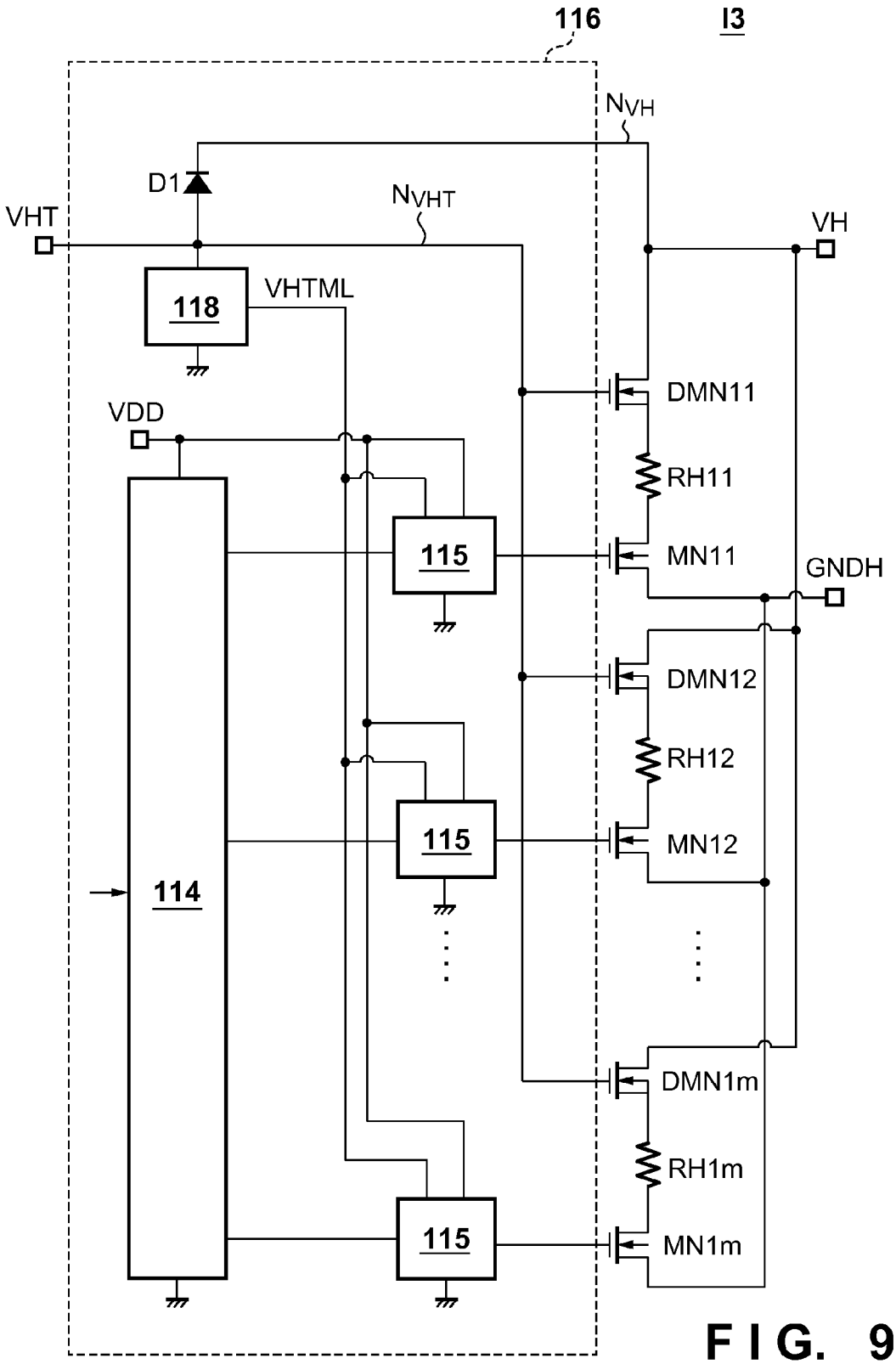
FIG. 9 is a circuit diagram for explaining still another example of the arrangement of the printing element substrate.

A control method for the transistor DMN1 according to this embodiment is applicable to the arrangement of the second embodiment. For example, like a printing element substrate I3 shown in FIG. 9, the diode D1 may be used instead of the detection unit 112 and voltage generation unit 117. In this arrangement, when no voltage VH is supplied, the drain potential of the transistor DMN1 becomes close to the gate potential, thereby decreasing the gate-drain potential difference $V_{GD}$. Furthermore, as shown in FIG. 9, the voltage generation unit 117 may be omitted. In this arrangement, the power supply node $N_{VHT}$ supplies the voltage VHT to the gate terminal of a transistor DMN1*k*.

In this embodiment, the diode D1 functions as a controlling unit for controlling the voltage of the drain terminal of the transistor DMN1. Note that one diode D1 is shown in this embodiment. However, an arrangement including two or more diodes may be adopted, and these diodes may be distributed and arranged according to a chip layout. To reduce the load of the power supply of the voltage VHT, two or more diodes may be arranged in series to suppress the voltage supply capacity to the power supply node $N_{VH}$. When the voltages VH and VHT are almost equal to each other, the diode D1 may be arranged between the power supply nodes $N_{VHT}$ and $N_{VH}$ so that the cathode is set on the $N_{VHT}$ side and the anode is set on the $N_{VH}$ side. By connecting the diode D1 in this manner, the breakdown voltage (for example, 7 V) of the diode D1 can be used as a threshold. Furthermore, the arrangement using the diode D1 has been exemplified above. The present invention, however, is not limited to this, and it is only necessary to adopt an arrangement having the similar function. For example, a diode-connected transistor (connection transistor) may be used instead of the diode D1. In this case, when the potential difference between the power supply nodes $N_{VHT}$ and $N_{VH}$ becomes higher than the threshold voltage of the transistor, the power supply node $N_{VHT}$ supplies a voltage to the power supply node $N_{VH}$.

(Fourth Embodiment)

Figure 10A:
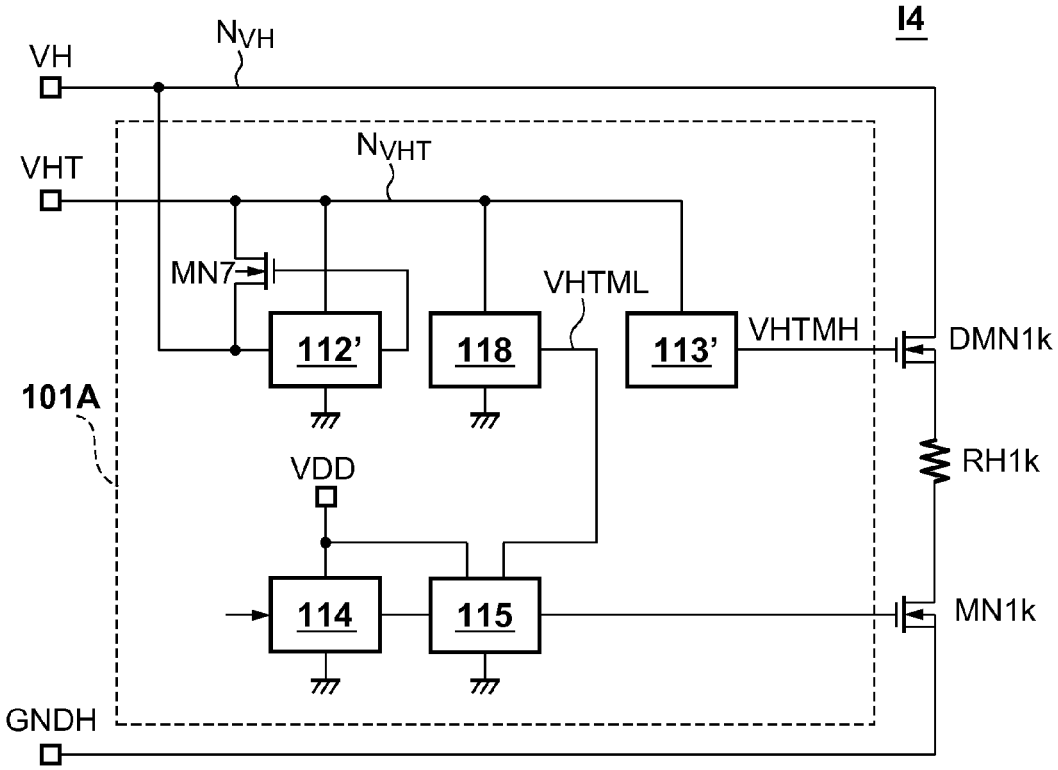
FIGS. 10A and 10B are circuit diagrams for explaining still another example of the arrangement of the units.

A printing element substrate I4 according to the fourth embodiment will be described with reference to FIGS. 10A and 10B. FIG. 10A shows an example of the arrangement of the printing element substrate I4. The arrangement of a unit 101A in this embodiment is different from that in the first or third embodiment in that a detection unit 112' is used to control an NMOS transistor MN7 based on the potential of a power supply node $N_{VH}$. More specifically, the transistor MN7 is arranged to form a current path between the power supply node $N_{VH}$ and a power supply node $N_{VHT}$. The gate of the transistor MN7 receives the output of the detection unit 112'. The detection unit 112' need only be configured to render the transistor MN7 conductive when no voltage VH is supplied. Note that although one heater RH1*k*, one transistor DMN1*k*, and one transistor MN1*k* are shown for the sake of simplicity, their numbers are not limited to them in this embodiment.

Figure 10B:
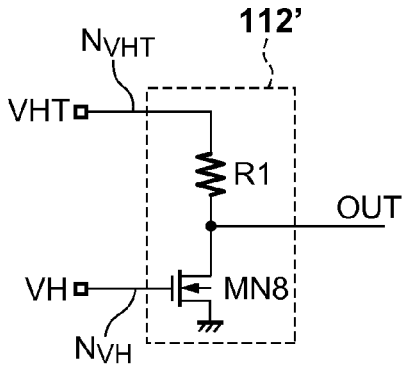

FIG. 10B shows an example of the arrangement of the detection unit 112'. The detection unit 112' can be formed using, for example, a resistance element R1 and a transistor MN8. With this arrangement, when the voltage VH is supplied, the detection unit 112' outputs a divided voltage by the resistance element R1 and the transistor MN8. The resistance element R1 and the transistor MN8 need only be designed so that the divided voltage renders the transistor MN7 non-conductive, for example, so that the divided voltage is almost equal to 0 [V].

On the other hand, when no voltage VH is supplied, the output of the detection unit 112' becomes equal to the potential of the power supply node $N_{VHT}$, thereby rendering the transistor MN7 conductive. This electrically connects the power supply nodes $N_{VH}$ and $N_{VHT}$ to each other, and the power supply node $N_{VHT}$ supplies a voltage to the power supply node $N_{VH}$ via the transistor MN7. As a result, the potential of the power supply node $N_{VH}$ rises, and the drain potential of the transistor DMN1 becomes close to the gate potential, thereby decreasing a gate-drain potential difference $V_{GD}$.

Note that since the voltage VH and a voltage VHT or voltages close to them can be applied to the transistors MN7 and MN8, the above-described high-breakdown voltage transistors are preferably used. Other components are the same as those in each of the aforementioned embodiments, and a description thereof will be omitted.

As described above, in this embodiment, it is also possible to obtain the same effects as those in the third embodiment. The embodiment is advantageous in preventing an insulation breakdown of the transistor DMN1*k* when no voltage VH is supplied.

Although the four embodiments have been described above, the present invention is not limited to them. The embodiments can be appropriately changed in accordance with the purpose, state, application, function, and other specifications, and the present invention can also be implemented by another embodiment. For example, an arrangement using a heater (electrothermal transducer) as a printing element has been exemplified in each of the above-described embodiments, but a printing method using a piezoelectric element or another known printing method may be adopted. Furthermore, for example, each parameter (a voltage value or the like) can be changed in accordance with the specification and application, and each unit can be accordingly changed so as to appropriately operate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-157117, filed Jul. 29, 2013, which is hereby incorporated by reference herein in its entirety.

What is claimed is:

1. A printing element substrate comprising:

a printing element;

a MOS transistor having a drain terminal, a source terminal and a back gate terminal, the drain terminal being connected to a first power supply node for receiving a first voltage, and the source terminal and the back gate terminal being connected to the printing element; and a unit including a second power supply node different from the first power supply node, and configured to supply a second voltage to a gate terminal of the MOS transistor, wherein, when the first voltage is not supplied to the first power supply node, the unit controls a potential of at least one of the gate terminal and the drain terminal so that a potential difference between the gate terminal and the drain terminal becomes lower than the second voltage.

2. The substrate according to claim 1, wherein the unit further includes a level shifter connected to the second power supply node, and configured to output a signal of the second voltage to the gate terminal of the MOS transistor, a third power supply node configured to receive a third voltage, and a voltage generation unit configured to generate, using the third voltage, a voltage to be supplied to the second power supply node, and when the first voltage is not supplied to the first power supply node, the unit controls the voltage generation unit to enter a sleep state.

3. The substrate according to claim 2, wherein the unit includes an n-channel transistor and a resistance element, a drain terminal of the n-channel transistor is connected to the third power supply node, and a gate terminal of the n-channel transistor is connected to the first power supply node, and the resistance element is arranged between a ground node and a source terminal of the n-channel transistor.

4. The substrate according to claim 1, wherein the unit includes a diode configured to connect the first power supply node and the second power supply node to each other.

5. The substrate according to claim 4, wherein the second power supply node is connected to the gate terminal of the MOS transistor.

6. The substrate according to claim 1, wherein the unit includes a level shifter connected to the second power supply node, and configured to output a signal of the second voltage to the gate terminal of the MOS transistor, a third power supply node configured to receive a third voltage, and a voltage generation unit configured to generate, using the third voltage, a voltage to be supplied to the second power supply node, wherein the unit includes a diode configured to connect the first power supply node and the third power supply node to each other.

7. The substrate according to claim 1, wherein the unit includes a connection transistor configured to connect the first power supply node and the second power supply node to each other, and when the first voltage is not supplied, the unit controls the connection transistor to be conductive.

8. The substrate according to claim 7, wherein the unit includes an n-channel transistor and a resistance element, a source terminal of the n-channel transistor is connected to a ground node, a gate terminal of the n-channel transistor is connected to the first power supply node, and the resistance element is arranged between the second power supply node and the drain terminal of the n-channel transistor.

9. The substrate according to claim 1, wherein the MOS transistor operates as a source follower.

10. The substrate according to claim 1, further comprising a second MOS transistor having a drain terminal connected to the printing element, and a source terminal connected to a ground node.

11. The substrate according to claim 1, wherein when the first voltage is supplied, the unit outputs, to the gate terminal of the MOS transistor, an inactive signal which renders the MOS transistor non-conductive.

12. The substrate according to claim 1, wherein the MOS transistor is formed by a DMOS transistor.

13. The substrate according to claim 1, wherein the printing element substrate includes a plurality of printing elements.

14. The substrate according to claim 1, wherein a first semiconductor region having a first conductivity type is provided in the substrate, a second semiconductor region having a second conductivity type is provided in the first semiconductor region, a drain semiconductor region of the drain terminal having the first conductivity type is provided in the first semiconductor region, a source semiconductor region of the source terminal having the first conductivity type is provided in the second semiconductor region, a first field region is provided between the drain semiconductor region and the source semiconductor region, a gate electrode is provided on a part of the first semiconductor region, on a part of the second semiconductor region and on a part of the first field region.

15. The substrate according to claim 14, wherein a back-gate semiconductor region having the second conductivity type is provided in the second semiconductor region, and a second field region is provided between the source semiconductor region and the back-gate semiconductor region.

16. A printhead comprising:

a printing element substrate defined in claim 1; and an ink orifice arranged to correspond to a printing element, and configured to discharge ink in response to a flow of a current through the printing element.

17. A printing apparatus comprising:

a printhead defined in claim 16; and a printhead driver configured to drive the printhead.

* * * * *